US007959483B2

(12) United States Patent
Sekine et al.

(10) Patent No.: US 7,959,483 B2
(45) Date of Patent: Jun. 14, 2011

(54) AIRTIGHT CONTAINER MANUFACTURING METHOD INVOLVES IRRADIATING AN ELECTRON BEAM TO A NON-EVAPORABLE TYPE GETTER SO AS NOT TO ACTIVATE IT BEFORE A SEALING PROCESS

(75) Inventors: Takayuki Sekine, Fujisawa (JP); Yoichi Ando, Inagi (JP); Yasue Sato, Machida (JP); Makoto Kojima, Atsugi (JP); Kota Iwasaki, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 12/465,198

(22) Filed: May 13, 2009

(65) Prior Publication Data

US 2009/0291611 A1 Nov. 26, 2009

(30) Foreign Application Priority Data

May 22, 2008 (JP) ..... 2008-134317

(51) Int. Cl.
*H01J 9/38* (2006.01)
*H01J 9/00* (2006.01)
*F04B 37/02* (2006.01)

(52) U.S. Cl. ..... 445/41; 445/38; 445/23; 417/51; 417/48

(58) Field of Classification Search ..... None
See application file for complete search history.

(56) References Cited

U.S. PATENT DOCUMENTS

| | | | | |
|---|---|---|---|---|
| 6,278,234 | B1 * | 8/2001 | Ono et al. | 313/495 |
| 6,283,815 | B1 * | 9/2001 | Iwasaki et al. | 445/41 |
| 6,517,403 | B1 * | 2/2003 | Cooper et al. | 445/25 |
| 6,652,343 | B2 * | 11/2003 | Hasegawa et al. | 445/25 |
| 6,860,779 | B2 * | 3/2005 | Fujimura et al. | 445/25 |
| 7,152,433 | B2 * | 12/2006 | Nakata | 65/32.2 |
| 2009/0197498 | A1 | 8/2009 | Miura et al. | 445/55 |

FOREIGN PATENT DOCUMENTS

| | | |
|---|---|---|
| JP | 7-296732 | 11/1995 |
| JP | 2000-133136 | 5/2000 |

* cited by examiner

*Primary Examiner* — Toan Ton
*Assistant Examiner* — Britt D Hanley
(74) *Attorney, Agent, or Firm* — Fitzpatrick, Cella, Harper & Scinto

(57) ABSTRACT

Provided is a manufacturing method of forming an airtight container including an electron beam irradiation process for irradiating an electron beam to a non-evaporable type getter that has not been activated so as not to activate the non-evaporable type getter, and a sealing process for sealing a seal portion after the electron beam irradiation process.

8 Claims, 7 Drawing Sheets

AIRTIGHT CONTAINER MANUFACTURING METHOD INVOLVES IRRADIATING AN ELECTRON BEAM TO A NON-EVAPORABLE TYPE GETTER SO AS NOT TO ACTIVATE IT BEFORE A SEALING PROCESS

BACKGROUND OF THE INVENTION

1. Field of the Invention

The present invention relates to manufacturing methods of an airtight container and an image display apparatus. In particular, the present invention relates to manufacturing methods of an airtight container and an image display apparatus, each of which includes a non-evaporable type getter.

2. Description of the Related Art

There is known a planar type image display apparatus, which irradiates an electron beam emitted from electron emitting elements provided on a planar substrate onto a phosphor on an opposite substrate, to allow the phosphor to emit light for displaying an image. For such an image display apparatus, it is necessary to hold, at a high vacuum, an inside of an airtight container that includes therein the electron emitting elements and the phosphor. This is because, when gas is generated in the inside of the airtight container and a pressure thereof rises, the electron emitting elements are adversely affected to decrease an amount of electrons emitted therefrom though a magnitude of the adverse effect differs depending on a type of the gas.

In order to solve such a problem, a structure has been proposed, in which a getter is formed in the inside of the airtight container, and the gas generated therein is adsorbed to the getter.

Here, the getter includes an evaporable type getter and a non-evaporable type getter. There are types of the gas which are more likely to be adsorbed to the getter and those that are less likely to be adsorbed thereto. The evaporable type getter has an extremely high exhaust speed for water and oxygen, but has an extremely low exhaust speed for inert gas such as argon (Ar). Further, the non-evaporable type getter also has an extremely low exhaust speed for the inert gas such as Ar. In particular, a non-evaporable type getter deposited by a sputtering method using Ar contains Ar gas in an inside thereof, and emits the Ar gas after the airtight container is formed. Accordingly, a pressure of the Ar gas in the airtight container rises.

In this connection, Japanese Patent Application Laid-Open No. H07-296732 discloses a method of preheating the non-evaporable type getter, and thereby degassing a surface of the getter.

Further, Japanese Patent Application Laid-Open No. 2000-133136 discloses a method of irradiating the electron beam onto the non-evaporable type getter while exhausting the inside thereof by an exhaust pipe, and thereby activating the getter.

SUMMARY OF THE INVENTION

However, in the method of preheating the non-evaporable type getter, and thereby degassing the surface of the getter, such degassing by the preheating has not always been sufficient. Accordingly, at the time of activating the getter, new gas is undesirably generated in the airtight container.

Further, in the method of irradiating the electron beam onto the non-evaporable type getter, and thereby activating the getter, the gas generated at the time of activating the getter is undesirably adsorbed to the activated getter again. Therefore, efficiency of the degassing is undesirably decreased.

In this connection, it is an object of the present invention to provide a method for efficiently manufacturing an airtight container capable of suppressing a rise of a pressure in an inside thereof.

A manufacturing method of an airtight container, comprising:

an electron beam irradiation process for irradiating an electron beam to a non-evaporable type getter that has not been activated so as not to activate the non-evaporable type getter; and a sealing process for sealing a seal portion after the electron beam irradiation process, and thereby forming the airtight container.

According to the present invention, the airtight container capable of suppressing the rise of the pressure in the inside of the airtight container can be manufactured efficiently.

Further features of the present invention will become apparent from the following description of exemplary embodiments with reference to the attached drawings.

DETAILED DESCRIPTION OF THE EMBODIMENTS

A description is made below of embodiments of the present invention with reference to the drawings.

The present invention relates to a manufacturing method of an airtight container, and in particular, a description is made below of a case of applying the present invention to an image display apparatus including electron emitting elements.

First Embodiment

Structure of Image Display Apparatus

Figure 1:
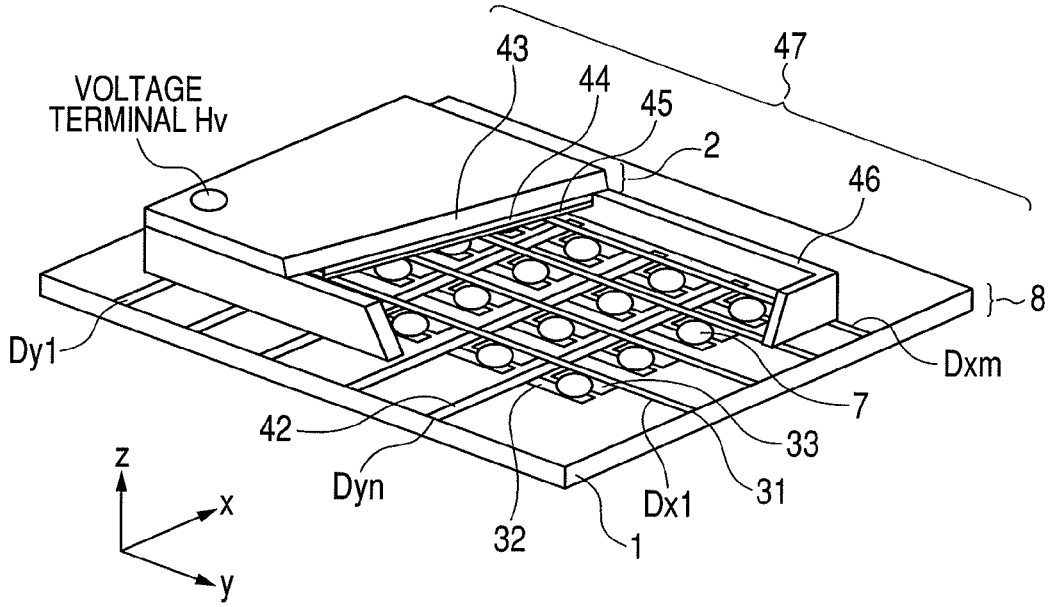
FIG. 1 is a view illustrating an example of a structure of an image display apparatus.

FIG. 1 is a perspective view illustrating an example of a structure of an image display apparatus, illustrating the image display apparatus in a partially cutaway manner.

As illustrated in FIG. 1, in this embodiment, an airtight container 47 is formed in a form in which a rear plate 8 and a face plate 2 sandwich a support frame 46 therebetween.

The rear plate 8 is at least formed of: an electron source substrate 1; and electron emitting elements 7, electrical connecting terminals Dx1 to Dxm and Dy1 to Dyn, row wires 31, column wires 42, and element electrodes 32 and 33, which are arranged on the electron source substrate 1. The electrical connecting terminals Dx1 to Dxm and Dy1 to Dyn are terminals for feeding power to the electron emitting elements 7 from an outside of the airtight container 47, and are electrically connected to the row wires 31 and the column wires 42, respectively. The element electrodes (high voltage side) 33 and the element electrodes (low voltage side) 32 are electrically connected to the row wires 31 and the column wires 42, respectively, and are electrically connected to the electron emitting elements 7. By those element electrodes 32 and 33, voltages are applied to the electron emitting elements 7 from the outside of the airtight container 47. In this embodiment, surface conduction type electron emitting elements are used as the electron emitting elements 7.

The face plate 2 is at least formed of: a transparent substrate 43 such as glass; a phosphor film 44, and a metal back 45 as an anode electrode, which are arranged on the transparent substrate 43. Further, the phosphor film 44 is irradiated with an electron beam that transmits through the metal back 45 to which a high voltage is applied, and emits light in order to display an image. Further, a high voltage terminal Hv feeds power to the metal back 45 from the outside of the airtight container 47.

(Structure of Getter)

In general, in the image display apparatus using the electron emitting elements, in an inside of the airtight container, there exist residual gas at the time of sealing the airtight container, and gas emitted from the respective members in the inside of the airtight container. For the purpose of adsorbing those gases, a getter is provided on the rear plate 8 or the face plate 2, or on both thereof. In particular, it is desirable that a gas partial pressure in the vicinities of the electron emitting elements be low, and accordingly, it is desirable to place the getter on the rear plate 8.

Figure 2:
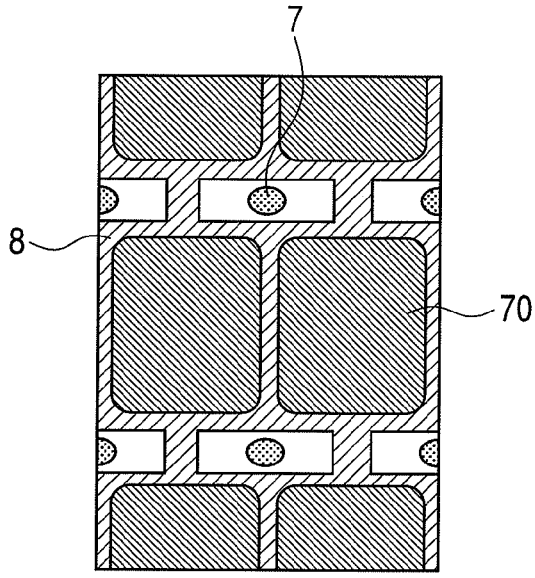
FIG. 2 is a view illustrating an example of a structure of a rear plate.

In this embodiment, as illustrated in FIG. 2, on regions of the rear plate 8, which are other than regions where the electron emitting elements 7 are provided, a non-evaporable type getter 70 is provided, which is made of a simple substance such as Ti, V, Zr, Fe, Pd, Ni, Mn, Co, Th, Cr, Y and La, or of an alloy thereof.

The non-evaporable type getter 70 is deposited by a sputtering method using Ar. Use of the non-evaporable type getter makes it possible to form a pattern of the getter easily.

(Electron Beam Irradiation Process)

Figure 3:
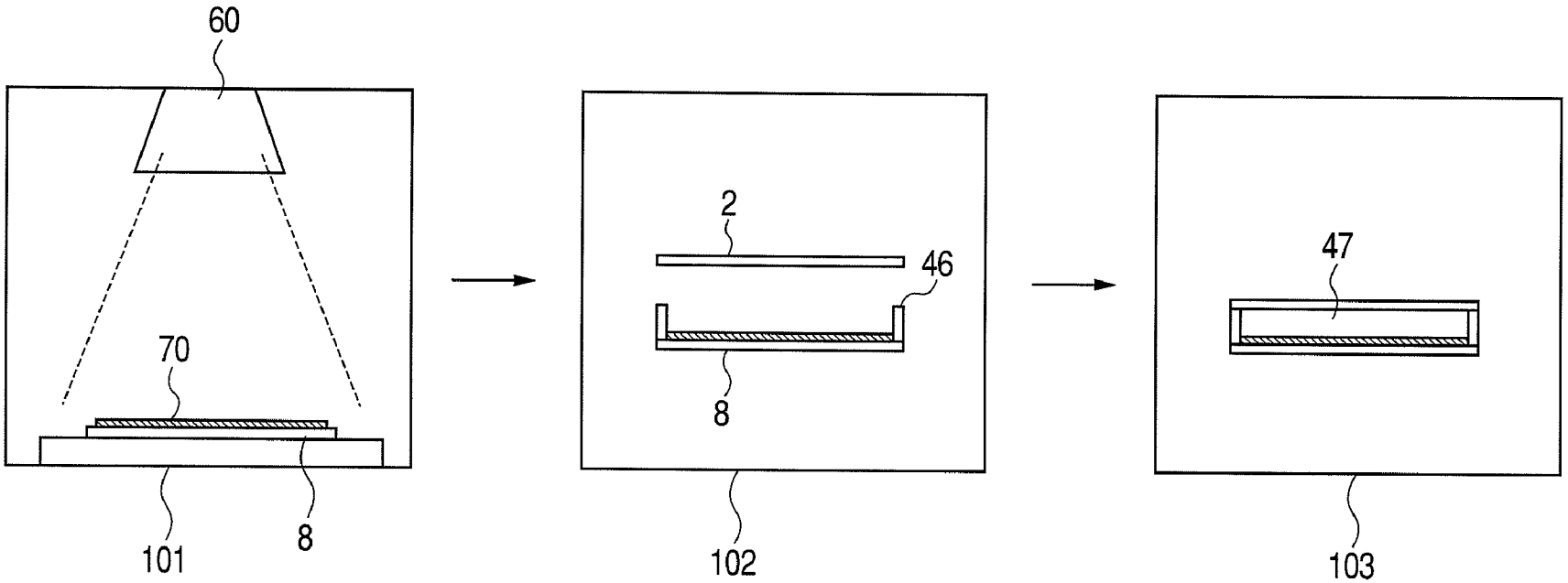
FIG. 3 is a view illustrating a manufacturing method of an airtight container in a first embodiment.

As illustrated in FIG. 3, the rear plate 8 on which the non-evaporable type getter 70 that is not activated is provided is conveyed into an electron beam irradiation chamber 101. The electron beam irradiation chamber 101 is maintained at a vacuum. Further, in the electron beam irradiation chamber 101, an electron beam generation unit 60 is provided. A thermionic electron source, a cold cathode type electron source or the like can be used as the electron beam generation unit 60. In terms of stability of electron emission, it is desirable to use the thermionic electron source as the electron beam generation unit 60.

After conveying the rear plate 8 into the electron beam irradiation chamber 101, the electron beam is irradiated onto the non-evaporable type getter 70 from the electron beam generation unit 60. At this time, it is desirable not to activate the non-evaporable type getter 70 in order to prevent deterioration of exhaust capability of the non-evaporable type getter 70. Accordingly, the electron beam generation unit 60 irradiates the non-evaporable type getter 70 with the electron beam so as not to activate the non-evaporable type getter 70. For example, it is desirable to irradiate the getter with the electron beam so that a temperature of the getter at the time of such electron beam irradiation cannot become higher than an activation temperature thereof.

Here, in general, a degree of the activation of the non-evaporable type getter depends not only on the temperature but also on time. If a material, amount, shape, and the like of the getter are determined, a maximum value of an exhaust speed of the getter is determined. It is hardly conceivable that the exhaust speed of the non-evaporable type getter is 0 (the non-evaporable type getter does not have any exhaust capability at all) at the time when the non-evaporable type getter concerned is formed by the sputtering method or the like. Accordingly, the fact that the non-evaporable type getter is not activated in the present invention refers to the case where an exhaust speed calculated when the maximum value of the exhaust speed of the above-mentioned getter is taken as a reference is less than 10%. On the other hand, the fact that the non-evaporable type getter is activated in the present invention refers to the case where the exhaust speed calculated when the maximum value of the exhaust speed of the above-mentioned getter is taken as the reference is 10% or more.

(Activation Process)

After the electron beam irradiation process, the rear plate 8 is conveyed into a bake processing chamber 102 while maintaining the periphery thereof at the vacuum. Then, the rear plate 8 is subjected to heating processing. By this heating processing, the non-evaporable type getter 70 is activated. In this embodiment, the face plate 2 and the support frame 46 are also subjected to the heating processing simultaneously as well as the rear plate 8.

(Sealing Process)

After the activation process, the rear plate 8, the face plate 2 and the support frame 46 are conveyed into a sealing chamber 103 while maintaining the peripheries thereof at the vacuum. Then, the rear plate 8, the face plate 2, and the support frame 46 are sealed together in a sealing unit that performs a sealing process for the support frame 46, whereby the airtight container 47 is formed. Laser sealing, heating sealing by energization, and the like can be used as a sealing method.

Note that a sequence of the activation process and the sealing process is not limited to a sequence described above, and the activation process may be performed after the sealing process. Alternatively, the activation process and the sealing process may be performed simultaneously. However, it is desirable to perform the sealing process after the activation process because the emitted gas in the activation process is exhausted by a vacuum apparatus to thereby inhibit the emitted gas from remaining in the inside of the airtight container 47.

Further, in this embodiment, separate chambers are used as the electron beam irradiation chamber 101, the bake processing chamber 102, and the sealing chamber 103. However, if the electron beam irradiation process, the activation process, and the sealing process can be performed in the same chamber, it is also possible to perform the above-mentioned processings in the same chamber.

According to this embodiment, the non-evaporable type getter is irradiated with the electron beam so as not to be activated, whereby the getter can be degassed efficiently. Accordingly, such a rise of the pressure in the inside of the airtight container can be suppressed.

Second Embodiment

Figure 4:
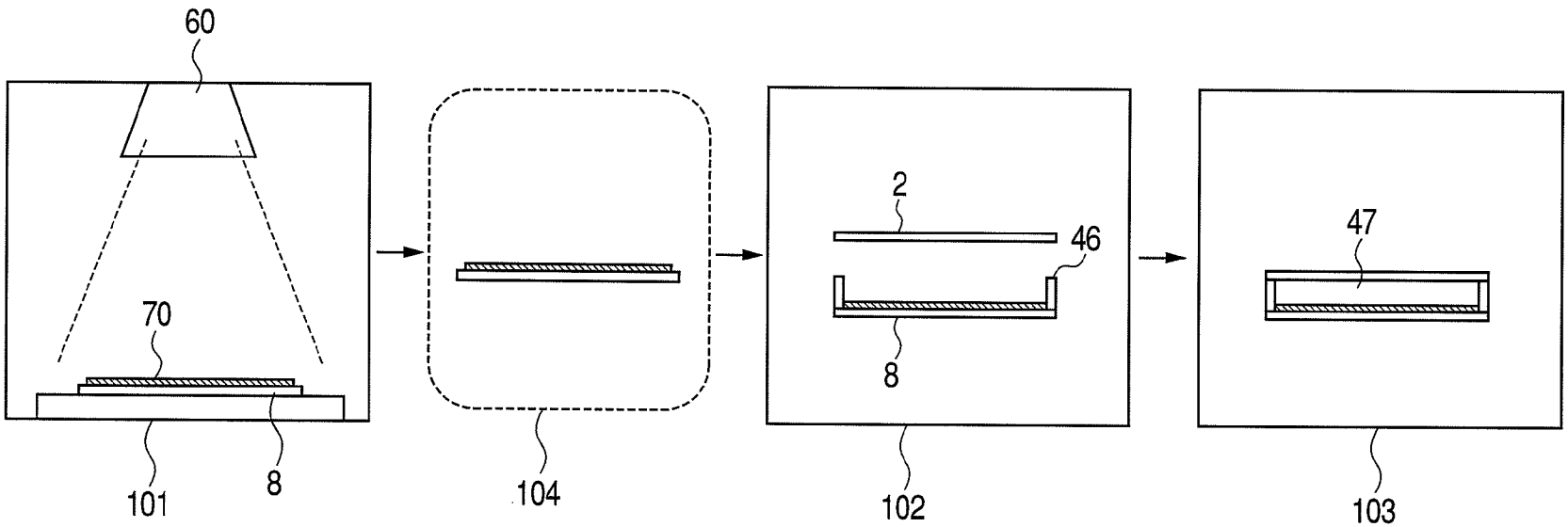
FIG. 4 is a view illustrating a manufacturing method of an airtight container in a second embodiment.

A description is made of a manufacturing method of an airtight container in this embodiment by using FIG. 4.

In this embodiment, an electron beam irradiation process, an activation process, and a sealing process are similar to those of the first embodiment. This embodiment is different from the first embodiment in that an extraction process is provided after the electron beam irradiation process, followed by the activation process and the sealing process. A description is made below of the extraction process.

(Extraction Process)

After the electron beam irradiation process, the rear plate 8 is extracted to an atmosphere of non-reduced pressure 104. For example, the atmosphere and a nitrogen atmosphere, in each of which a pressure is approximately the atmospheric pressure, can be used as the atmosphere of non-reduced pressure 104. In particular, the nitrogen atmosphere is desirable in terms of forming the vacuum after the airtight container is formed.

According to this embodiment, the non-evaporable type getter 70 is irradiated with the electron beam so as not to be activated, whereby the deterioration of the exhaust capability of the non-evaporable type getter can be suppressed even if the non-evaporable type getter is exposed to the atmosphere of non-reduced pressure. Accordingly, it becomes easy to store the rear plate after being subjected to the electron beam irradiation process. Further, it becomes possible to degas the getter and to store a plurality of the rear plates collectively, and accordingly, it becomes possible to perform the subsequent activation process and sealing process collectively for the plurality of rear plates. Therefore, manufacturing cost of the airtight container can be reduced.

EXAMPLE 1

In this example, as illustrated in FIG. 2, the non-evaporable type getter 70 was deposited on the rear plate 8 by the sputtering method using Ar and a liftoff process. Ti was used as the non-evaporable type getter 70.

After the deposition of the non-evaporable type getter 70, as illustrated in FIG. 4, the rear plate 8 was conveyed into the electron beam irradiation chamber 101. Then, the rear plate 8 was fixed so as to be opposite to the thermionic electron source as the electron beam generation unit 60, and the inside of the electron beam irradiation chamber 101 was thereafter evacuated.

While evacuating the electron beam irradiation chamber 101, an electron beam accelerated by an acceleration voltage of 10 kV was irradiated from the thermionic electron source onto the non-evaporable type getter 70. A current of the electron beam was set at 15 μA. By the irradiation of the electron beam and radiation thereof from the thermionic electron source, the non-evaporable type getter 70 was heated up to 190° C. An activation temperature of the non-evaporable type getter 70 for use in this example is approximately 350° C., and the non-evaporable type getter 70 was not activated when being irradiated with the electron beam by the thermionic electron source. After such irradiation of the electron beam was performed for two hours, the rear plate 8 was extracted into the atmosphere as the atmosphere of non-reduced pressure.

Figure 5:
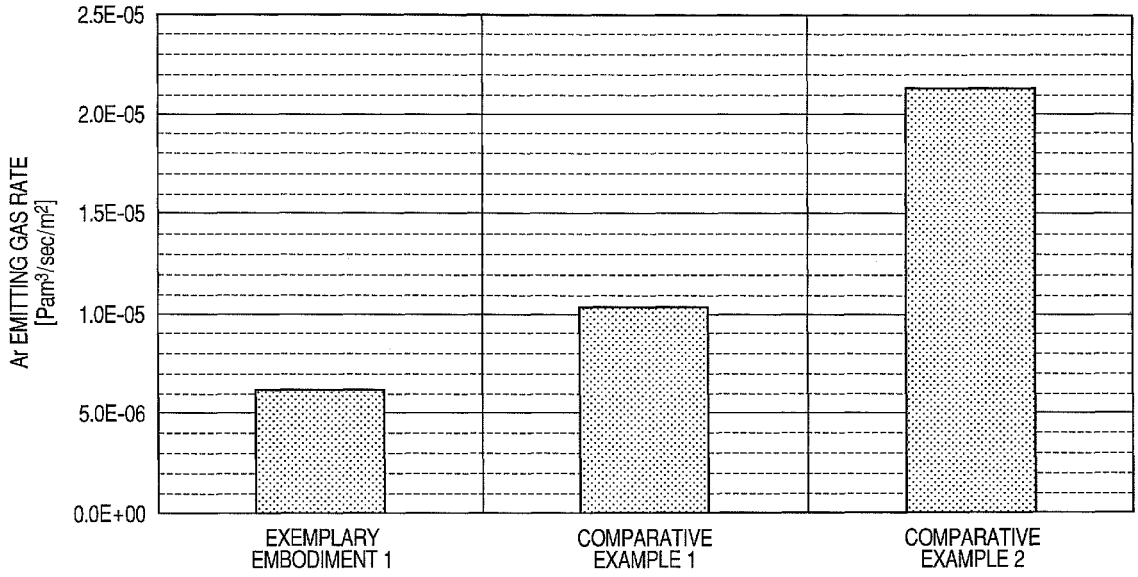
FIG. 5 is a graph illustrating results of measurement by Temperature Programmed Desorption.

Thereafter, for the non-evaporable type getter 70, an Ar emitting gas rate thereof was measured by Temperature Programmed Desorption. Results of the measurement are illustrated in FIG. 5. An axis of ordinates in FIG. 5 represents Ar emitting gas rates when the temperature of the non-evaporable type getter 70 is 350° C.

In comparison with comparative examples to be described later, it is understood that the non-evaporable type getter 70 is irradiated with the electron beam so as not to be activated, whereby such Ar gas degassing is performed effectively, and the Ar gas that remains in the non-evaporable type getter 70 after the degassing is performed is decreased.

Note that, though the Ar emitting gas rates at 350° C. only are illustrated in FIG. 5, also at other temperatures, the Ar emitting gas rates were in the ascending order of Example 1, Comparative example 1, and Comparative example 2.

Comparative Example 1

This comparative example is different from Example 1 in that the non-evaporable type getter 70 was heated up to 190° C. by heat without being irradiated with the electron beam in the electron beam irradiation chamber 101.

Specifically, the non-evaporable type getter 70 was conveyed into the electron beam irradiation chamber 101, the thermionic electron source opposite thereto was energized, and the non-evaporable type getter 70 was heated up to 190° C. At this time, an acceleration voltage applying power supply (not shown) was turned off, whereby the non-evaporable type getter 70 was made not to be irradiated with electrons. Such a heating state at 190° C. was held for two hours, and thereafter, the rear plate 8 was extracted into the atmosphere as the atmosphere of non-reduced pressure.

Thereafter, for the non-evaporable type getter 70, the Ar emitting gas rate thereof was measured by the Temperature Programmed Desorption. Results of the measurement are illustrated in FIG. 5.

It is understood that, in this comparative example, the Ar gas degassing was insufficient in comparison with the case where the non-evaporable type getter 70 was irradiated with the electron beam because such degassing only by the heating was performed therefor without irradiating the non-evaporable type getter 70 with the electron beam.

Comparative Example 2

This comparative example is different from Example 1 and Comparative example 1 in that the non-evaporable type getter 70 was not irradiated with the electron beam in the electron beam irradiation chamber 101, and that the heating by the heat was not performed.

Specifically, the non-evaporable type getter 70 was deposited on the rear plate 8 by the sputtering method using Ar and the liftoff process, and thereafter, for the non-evaporable type getter 70, the Ar emitting gas rate thereof was measured by the Temperature Programmed Desorption. Results of the measurement are illustrated in FIG. 5.

In this comparative example, the non-evaporable type getter 70 was not irradiated with the electron beam, or the degassing by the heating was not performed therefor, either. Therefore, in comparison with the case where the non-evaporable type getter 70 was irradiated with the electron beam and the case where the degassing by the heating was performed therefor, it is understood that the Ar gas that remains in the non-evaporable type getter 70 is increased.

EXAMPLE 2

In this example, as illustrated in FIG. 2, the non-evaporable type getter 70 was deposited on the rear plate 8 by the sputtering method using Ar and a liftoff process. Ti was used as the non-evaporable type getter 70.

(Electron Beam Irradiation Process)

After the deposition of the non-evaporable type getter 70, as illustrated in FIG. 4, the rear plate 8 was conveyed into the electron beam irradiation chamber 101. Then, the rear plate 8 was fixed so as to be opposite to the thermionic electron source as the electron beam generation unit 60, and the inside of the electron beam irradiation chamber 101 was thereafter evacuated.

Figure 6:
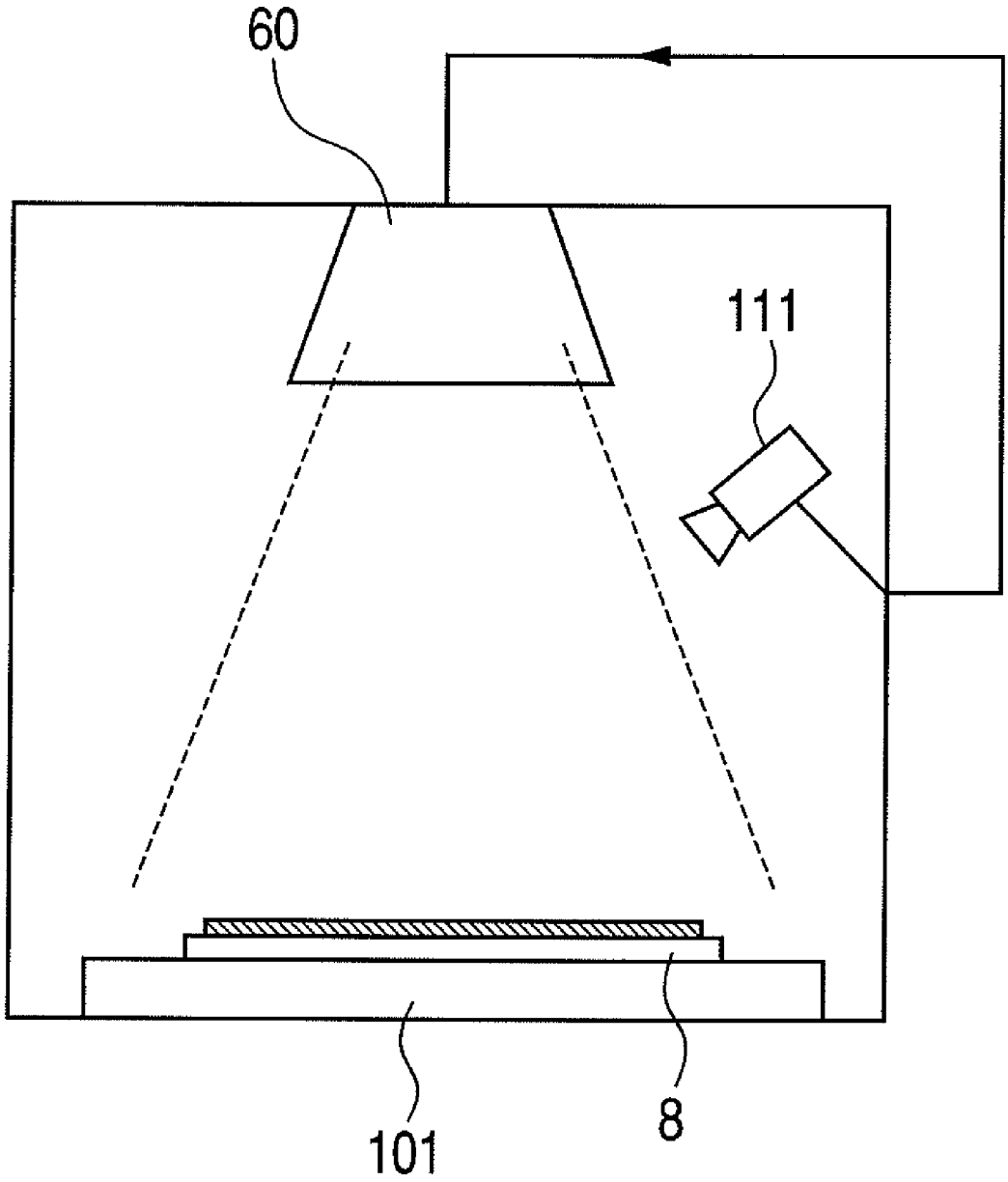
FIG. 6 is a view illustrating an electron beam irradiation chamber in Example 2.
Figure 7:
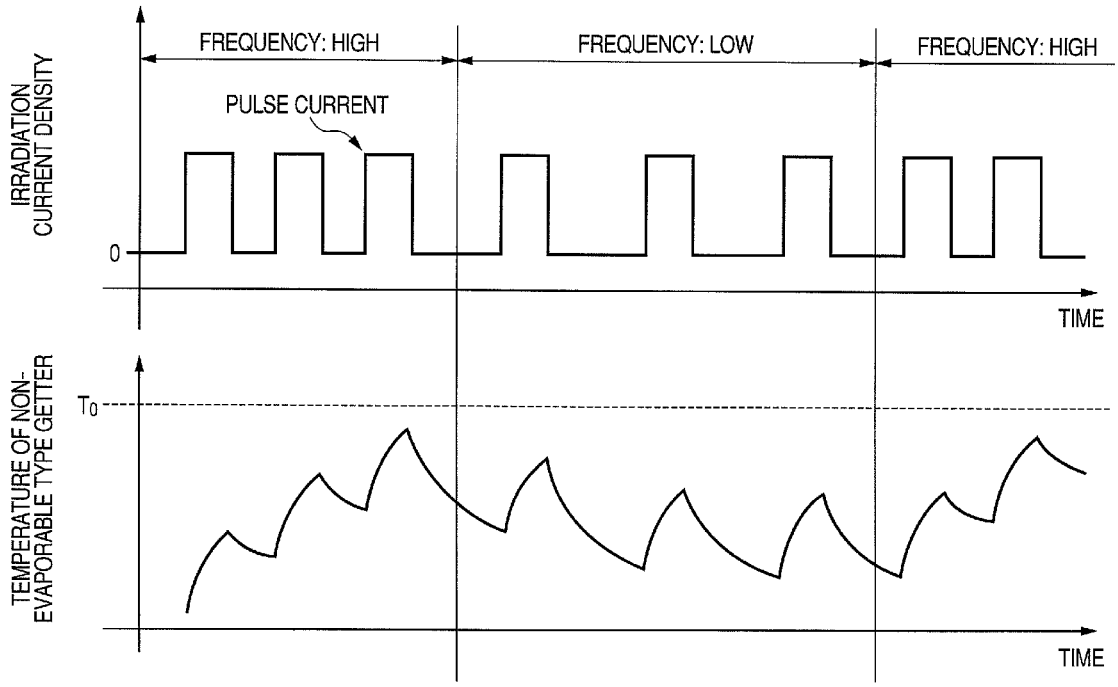
FIG. 7 is a chart illustrating an electron beam irradiation pulse in Example 2.

As illustrated in FIG. 6, a radiation thermometer 111 is provided in the electron beam irradiation chamber 101. The radiation thermometer 111 measures a surface temperature of the non-evaporable type getter 70. The electron beam accelerated by the acceleration voltage of 10 kV was irradiated in a rectangular pulse shape illustrated in FIG. 7 from the thermionic electron source. A pulse width of the electron beam is two seconds, and a maximum current density thereof is 0.1 $A/m^2$. A frequency of such a pulse was adjusted by using a feedback circuit (not shown) so that a measurement result of the temperature of the non-evaporable type getter 70, which is measured by the radiation thermometer 111, can become a reference temperature $T_0$ or lower. Specifically, the frequency of the pulse was adjusted to become low when the temperature of the non-evaporable type getter 70 approached the reference temperature, and the frequency of the pulse was adjusted to become high when the temperature of the non-evaporable type getter 70 dropped to some extent. This electron beam irradiation was performed for two hours. The frequency of the pulse was adjusted in such a manner as described above, whereby a period while the irradiation of the electron beam is being stopped is adjusted, and the temperature of the non-evaporable type getter 70 can be adjusted. Note that the reference temperature was set at 190° C. in this example.

(Extraction Process)

Thereafter, the electron beam irradiation chamber 101 was opened to the atmosphere, and the rear plate 8 was extracted to the atmosphere. The rear plate 8 thus extracted was stored in a storehouse at the atmosphere of non-reduced pressure.

(Activation Process)

The rear plate 8 was conveyed into the bake processing chamber 102 together with the face plate 2 and the support frame 46. The rear plate 8 and the face plate 2 were fixed so as to be opposed to each other while sandwiching the support frame 46 therebetween. The bake processing chamber 102 was then evacuated.

While evacuating the bake processing chamber 102, each of the substrates was heated at a rate of 5° C. per minute, and was heated at 350° C. for 30 minutes. At this time, the non-evaporable type getter 70 on the rear plate 8 was activated, and came to have the exhaust capability. After each substrate was cooled down, each substrate was conveyed from the bake processing chamber 102 into the sealing chamber 103 while maintaining the periphery thereof at the vacuum.

(Sealing Process)

The inside of the sealing chamber 103 was maintained at the vacuum by the vacuum apparatus. In the sealing chamber 103, each substrate was positionally aligned with the other, and indium provided in the support frame 46 was heated. After the indium was molten, the rear plate 8 and the face plate 2 were adhered onto each other. After such sealing, the airtight container was cooled down to the room temperature at a rate of 3° C. per minute, and was brought into an airtight state by curing a sealing material. In such a way, the airtight container 47 was formed.

Note that, though the radiation thermometer 111 was used as means for measuring the temperature of the non-evaporable type getter 70 in this example, a thermocouple and a contact type thermometer such as a resistance thermometer may also be used. Further, in the case where it is previously known how the temperature of the non-evaporable type getter 70 rises depending on the time of irradiating the electron beam, it is also possible to adjust the irradiation and non-irradiation of the electron beam based on such a known degree of the temperature rise.

Further, the pulse width of the pulse in the electron beam irradiation process may also be a pulse width ranging from several seconds to several ten minutes or more. Further, such a parameter to be controlled in a feedback manner may be a parameter such as the pulse width and the maximum current density, which is other than the frequency of the pulse.

According to this example, the adjustment of the irradiation and non-irradiation of the electron beam allows the non-evaporable type getter 70 to be controlled so as not to be activated, and accordingly, this example is preferable in that it is not necessary to provide a component such as a cooler.

EXAMPLE 3

This example is different from Example 2 in the electron beam irradiation process.

(Electron Beam Irradiation Process)

Figure 8:
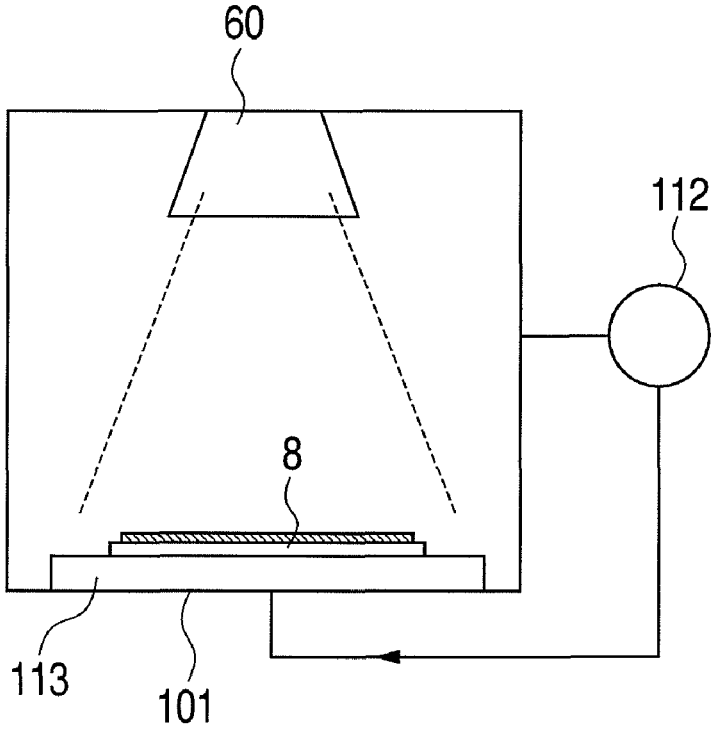
FIG. 8 is a view illustrating an electron beam irradiation chamber in Example 3.

FIG. 8 illustrates an electron beam irradiation chamber 101 that performs the electron beam irradiation process of this example. After the deposition of the non-evaporable type getter 70, the rear plate 8 was conveyed into the electron beam irradiation chamber 101. After the rear plate 8 was fixed onto a cooler 113, an inside of the electron beam irradiation chamber 101 was evacuated.

An ionization gauge 112 is provided in the electron beam irradiation chamber 101. The ionization gauge 112 measures a pressure in the electron beam irradiation chamber 101. The electron beam accelerated by the acceleration voltage of 10 kV was irradiated from the thermionic electron source onto the non-evaporable type getter 70 at a current density of 0.01 $A/m^2$.

At the time of the irradiation of the electron beam, when a reduction rate of the pressure in the electron beam irradiation chamber 101, which was measured by the ionization gauge 112, exceeded a predetermined value, the cooler 113 was driven to cool down the non-evaporable type getter 70. The matter that the pressure in the electron beam irradiation chamber 101 starts to be reduced means that the non-evaporable type getter 70 starts to have the exhaust capability. Therefore, the non-evaporable type getter 70 is cooled down when the reduction rate of the pressure in the electron beam irradiation chamber 101 has exceeded the predetermined value, whereby the non-evaporable type getter 70 can be made not to be activated.

Figure 9:
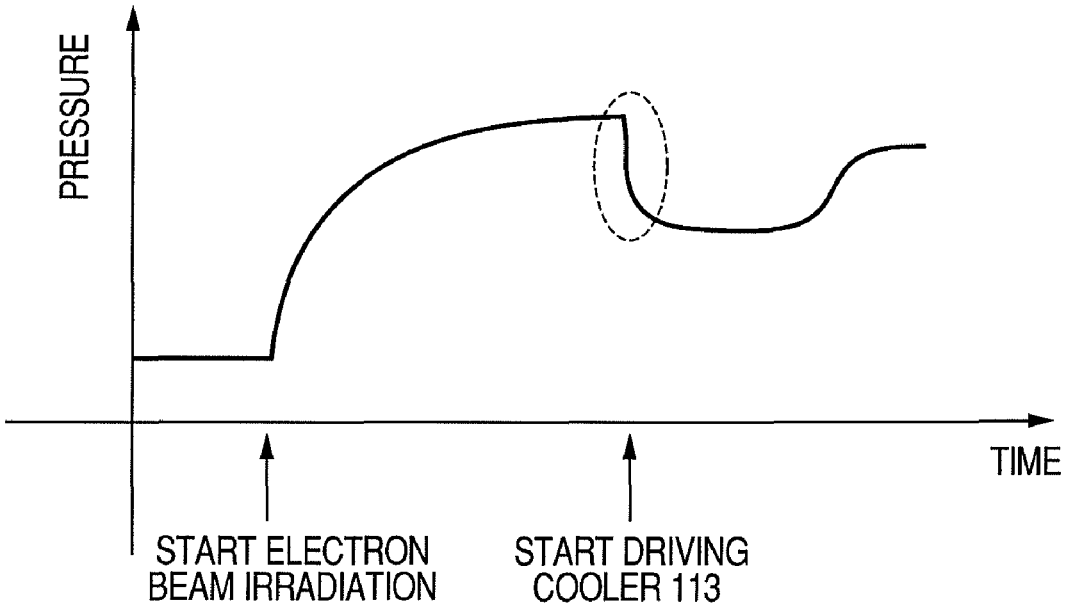
FIG. 9 is a chart illustrating a temporal change of a pressure in the electron beam irradiation chamber in Example 3.

FIG. 9 is a chart illustrating a temporal change of the pressure in the electron beam irradiation chamber 101 in this example. An axis of abscissas in the chart represents a time, and an axis of ordinates therein represents the pressure in the electron beam irradiation chamber 101. When the irradiation of the electron beam is started, the degassing is performed, and the pressure in the electron beam irradiation chamber 101 is increased. However, the pressure is reduced in a portion in FIG. 9, which is indicated by a dotted line. In this example, the cooler 113 is set to be driven when the reduction rate of the pressure exceeds 15% per second. It is understood that the reduction of the pressure is suppressed by driving the cooler 113. This means that the non-evaporable type getter 70 is not activated. This electron beam irradiation was performed for two hours. Thereafter, the extraction process, the activation process, and the sealing process were performed in a similar way to Example 2.

EXAMPLE 4

In this example, as illustrated in FIG. 2, a non-evaporable type getter 70 was deposited on the rear plate 8 by the sputtering method using Ar and the liftoff process. Ti was used as the non-evaporable type getter 70.

(Electron Beam Irradiation Process)

An electron beam irradiation process is similar to that in Example 2.

(Activation Process)

After the electron beam irradiation process, while maintaining the periphery of the rear plate 8 at the vacuum without exposing the rear plate 8 to the atmosphere of non-reduced pressure, the rear plate 8 was conveyed into the bake processing chamber 102 together with the face plate 2 and the support frame 46. The subsequent activation process and sealing process are similar to those of Example 2.

Note that, though it has been described above that the electron beam irradiation process of this example is similar to that of Example 2, the electron beam irradiation process of Example 3 can also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-134317, filed May 22, 2008, which is hereby incorporated by reference herein in its entirety.

What is claimed is:

1. A manufacturing method of an airtight container, comprising:

an electron beam irradiation process for irradiating an electron beam to a non-evaporable type getter that has not been activated so as not to activate the non-evaporable type getter; and a sealing process for sealing a seal portion to form an airtight container after the electron beam irradiation process.

2. The manufacturing method of the airtight container according to claim 1, further comprising:

an extraction process for exposing the non-evaporable type getter in an atmosphere of non-reduced pressure after the electron beam irradiation process and before the sealing process.

3. The manufacturing method of the airtight container according to claim 1, further comprising:

an activation process for activating the non-evaporable type getter after the sealing process.

4. The manufacturing method of the airtight container according to claim 1, wherein the electron beam irradiation process has a process for measuring a temperature of the non-evaporable type getter and adjusting the temperature of the non-evaporable type getter according to a result of the measurement.

5. The manufacturing method of the airtight container according to claim 1, wherein the electron beam irradiation process has a process for measuring an internal pressure of a vacuum apparatus that performs the electron beam irradiation process and adjusting a temperature of the non-evaporable type getter according to a result of the measurement.

6. The manufacturing method of the airtight container according to claim 4, wherein the electron beam irradiation process has a process for adjusting the temperature of the non-evaporable type getter by stopping the irradiation of the electron beam.

7. The manufacturing method of the airtight container according to claim 5, wherein the electron beam irradiation process has a process for adjusting the temperature of the non-evaporable type getter by stopping the irradiation of the electron beam.

8. A manufacturing method of an image display apparatus comprising:

forming electron emitting elements; and forming an airtight container by the manufacturing method according to claim 1.

* * * * *